US006786835B1

(12) United States Patent
Carter

(10) Patent No.: US 6,786,835 B1
(45) Date of Patent: Sep. 7, 2004

(54) PUTTER GRIP AND METHOD

(76) Inventor: Gary W. Carter, 5813 McGuire Rd., Edina, MN (US) 55439

( * ) Notice: Subject to any disclaimer, the term of this patent is extended or adjusted under 35 U.S.C. 154(b) by 0 days.

(21) Appl. No.: 10/733,885

(22) Filed: Dec. 12, 2003

(51) Int. Cl.[7] ..... A63B 53/14
(52) U.S. Cl. ..... 473/300
(58) Field of Search ..... 473/301, 302, 473/303, 304, 305, 201, 203, 204, 549, 298, 299

(56) References Cited

U.S. PATENT DOCUMENTS

| | | | | | |
|---|---|---|---|---|---|
| 1,677,099 | A | * | 7/1928 | Harness | 473/201 |
| 3,219,348 | A | * | 11/1965 | Dishner, Jr. | 473/204 |
| 3,837,647 | A | * | 9/1974 | Jacques | 473/300 |
| 4,067,573 | A | * | 1/1978 | Key, Jr. | 473/201 |
| 4,179,125 | A | * | 12/1979 | Cone et al. | 473/241 |
| D258,750 | S | | 3/1981 | Hallaman et al. | |
| D280,119 | S | | 8/1985 | McRae | |
| 4,746,120 | A | | 5/1988 | Mockovak | |
| 4,826,168 | A | | 5/1989 | McGuire et al. | |
| D345,192 | S | | 3/1994 | Solheim | |
| D355,011 | S | | 1/1995 | Subnick | |
| 5,377,984 | A | | 1/1995 | Ciccia | |
| D355,463 | S | | 2/1995 | Markward et al. | D21/222 |
| 5,460,372 | A | | 10/1995 | Cook | |
| 5,569,098 | A | | 10/1996 | Klein | |
| 5,571,050 | A | | 11/1996 | Huang | |
| 5,575,724 | A | | 11/1996 | Hannon et al. | |
| D377,070 | S | | 12/1996 | Gurrola | D21/222 |
| 5,595,544 | A | | 1/1997 | Roelke | |
| D379,837 | S | | 6/1997 | Chou et al. | D21/222 |
| 5,669,823 | A | | 9/1997 | McCready | |
| D391,330 | S | | 2/1998 | Solheim et al. | D21/222 |
| D392,357 | S | | 3/1998 | Chou et al. | D21/222 |
| 5,730,669 | A | | 3/1998 | Huang | |
| 5,733,204 | A | | 3/1998 | Carrara | |
| 5,772,525 | A | | 6/1998 | Klein | |
| 5,779,559 | A | | 7/1998 | Eberle | |
| 5,795,241 | A | | 8/1998 | Peshek | |
| 5,813,920 | A | * | 9/1998 | Rife | 473/300 |
| D408,461 | S | | 4/1999 | Lamkin | D21/222 |
| 5,906,548 | A | * | 5/1999 | Hadge | 473/206 |
| 5,910,054 | A | | 6/1999 | Huang | |
| 6,213,891 | B1 | | 4/2001 | Moore | |
| D464,694 | S | | 10/2002 | Moore | D21/222 |
| 6,551,198 | B2 | | 4/2003 | Huang | |
| 6,743,115 | B2 | * | 6/2004 | Rodarte | 473/294 |

* cited by examiner

*Primary Examiner*—Gregory Vidovich
*Assistant Examiner*—Nini F. Legesse
(74) *Attorney, Agent, or Firm*—Christopher J. Whewell

(57) ABSTRACT

Provided herein is a putter grip made of a flexible material which slips over the end of the club and attaches thereto in the traditional manner, either by interference fit or with a two-sided adhesive strip. The unique nature of the grip is in its size and shape, which allow the hands to grasp the club opposite each other, rather than being separated vertically. In a method using a putter equipped with a grip according to the invention, the palms rest on each side of the grip; the thumbs are side-by-side, extending downward on the bevels on each side of the front of the grip and the forefingers and middle fingers extend downward to the base of the grip. The small fingers overlap at the back of the grip. The method encourages consistent placement of the hands on the club and allows the hands to work in concert with minimum wrist movement. Through use of the grip and method of present invention, general improvements to all aspects contributing to dynamic-alignment may be easily achieved by the typical golfer.

20 Claims, 8 Drawing Sheets

PUTTER GRIP AND METHOD

TECHNICAL FIELD

This invention relates to golf clubs in general, and more specifically to a handle grip means which is particularly well-suited to be adapted to a golf putter, to provide new functional capabilities to the putter.

BACKGROUND INFORMATION

The game of golf is a lifetime sport that can be enjoyed by both genders. Besides socialization, it confers the health benefits of aerobic activity, flexibility, and hand-eye coordination. In the United States, an estimated 26.5 million people exercise by playing golf for health and enjoyment. Many attempt to improve their game by improving the quality of the clubs with which they play to influence the precision of their play. Most increases in the precision of a golfer's play, particularly in the critical alignment processes, usually result in an observable advantage in play, and an improvement over the prior art which affords a competitive benefit to golfers in a general sense and represents an advance in the state of the art of the game.

Golf putters generally comprise a shaft having a first end portion comprising the gripping end, a second end portion comprising the striking end, a head on the striking end of the shaft, and a grip sheath disposed over the gripping end of the shaft. The head has a connector that accepts the shaft and connects the head to the shaft. On the head, distal in relation to the shaft, is a toe end. Also on the head is a heel end that is proximal in relation to the shaft. There is a club face which resides between the heel and toe, which face portion is intended to be that portion of the club which strikes the ball, which is sometimes referred to as the "striking face" by those skilled in the art.

Putting is a major and critical part of the game of golf. On each hole of a golf course, two putts on the green are allocated to par. For example, on an 1 Whole course with par of 72 strokes, 36 strokes represent putts. Most low-handicap golfers are able to take fewer than 36 putts per round, making up for greens missed in regulation. Most high-handicap golfers take more than 36 putts.

Improvement of the putting method is the easiest way for most players to improve their score because the putter is the easiest golf club for most players to manipulate. A putt entails rolling the ball toward the hole, often with only a gentle tap of the putter blade, rather than launching the ball into the air with a striking blow.

There is no universal agreement among golf professionals on a preferred putting method or style. Most instructors stress that the putting stroke must be a smooth, fluid, and un-interrupted pendulum motion. Four decades ago, many Professional Golf Association (PGA) professionals putted with varying degrees of wrist movement, some using the wrists as the primary force behind the putt. Today it is generally accepted that the stroke should entail movement with only the arms and shoulders, with no body movement, and that the wrists should remain in a locked position, except perhaps for exceptionally long putts.

Many styles and methods of putting are popular today. The most popular method uses a traditional length putter (33" to 35") with the hands placed on the grip, left hand above the right hand (for a right-handed golfer), and fingers overlapping or interlocking. The back is bent so that the eyes are above the ball and the arms hang naturally. Some instructors stress that the putting motion should utilize the natural arc from the player's body, requiring a slight opening of the club face on the back-swing and closing of the club face on the follow-through. Others teach a straight-line movement through the ball, maintaining the position of the club face square to the target during the entire swing.

A persistent challenge of putting is to prevent the hands from turning or rotating the putter during either the back stroke or down stroke, causing the ball to veer from its intended path. To achieve greater control of the club-head and to prevent rotation, some golfers place the left hand below the right hand on the putter grip (e.g. PGA professional Bob May). Others use the "claw" grip (e.g. PGA professional Chris DiMarco), grasping the club with the left hand in the traditional way, but separating the right hand and clutching the club below the left hand between the thumb and forefinger. Others have turned to the "long putter," (e.g. PGA professional Vijay Singh) which has an upper and a lower grip attached. The club is anchored against the player's chest with the left hand on the upper grip, the right hand grasping the club on the lower grip between the thumb and forefinger. Still others use the "belly putter," (e.g. PGA professional Fred Couples) which is just long enough to anchor against the player's stomach. The hands grasp the club in the traditional way. All of these methods strive to achieve restricted hand and wrist movement so that the putter face remains in the identical position at impact as during alignment.

Another challenge of putting for many golfers is known as the "yips." The "yips" is manifested by severe involuntary movement of the lower arms, hands and/or wrists causing the ball to veer wildly offline or to zoom well past the hole. The "yips" has been defined by a multidisciplinary team at the Mayo Clinic as a psycho-neuromuscular impediment to executing the putting stroke. It is a poorly understood problem that resembles a focal dystonia (episodic twitching and jerking). Symptoms can worsen under conditions of anxiety and stress. ("The 'Yips': A Biomedical Investigation of a Common Problem in Golf," www.mayo.edu/research/yips/topic_475.html). Many famous golfers such as Ben Hogan, Tommy Armour, Sam Snead, and Berhard Langer have suffered from the "yips," greatly altering their ability to putt and to play the game.

There is no known cure for the "yips." The Mayo Clinic began studying the "yips" in 1998 in order to offer meaningful relief, but its research has not yet been concluded. According to the Mayo team, the "yips" adds an average of five strokes to the score of afflicted players, and typically affects low-handicap, loyal golfers who form the competitive and financial backbone of the game. In a Mayo Clinic survey of 2,600 golfers with a 12-and-under handicap, 53 percent of respondents reported experiencing the "yips." The Mayo team suggests that temporary relief may be possible with modifications such as changing one's grip or putter length, using psychological skill strategies, medications or alcohol—but symptoms usually reappear.

A putting method, and a putter grip to accommodate that method, that enhances a golfer's ability make a smooth, steady, and consistent stroke and to retard or inhibit movement of the hands and wrists, resulting in improved control of the putter-head and the ability to send the ball on the desired path, is a technological breakthrough. The present invention represents a radical departure from the prior art by providing a grip for a putter that is designed to be grasped by the user in a way heretofore unknown in the art, resulting in greater stability and precision in putting the ball.

While all known putting methods, and accommodating grips, rely on the player gripping the club with the fingers and placing the hands on the club above and below one another vertically, the present invention employs a symmetrical positioning of the palms on opposing sides of the club in identical vertical positions. This symmetry of the hands allows the player to employ a press on the club, emanating from the pectoral muscles, with each arm, wrist and hand counterbalancing the force exerted by the opposite member. This counter-balancing force inhibits the ability of each arm, hand and wrist to move involuntarily and may provide relief from the twitching and jerking symptomatic of the "yips." A grip according to the invention is affixed to any existing putter by simply sliding the grip over the shaft and attaching in the traditional manner.

SUMMARY OF THE INVENTION

The present invention provides a putter grip having a distal end, a proximal end, and a length dimension, and comprises a main grip portion having a first end portion and a second end portion, wherein the first end portion of the main grip portion coincides substantially with the proximal end of the grip. There is a tapered grip portion having a first end portion and a second end portion, wherein the first end portion of the tapered grip portion coincides substantially with the distal end of the grip. The second end portion of the main grip portion is attached to the second end portion of the tapered grip portion. There is a bore disposed through the grip, having an open end which comprises a hole at the distal end of the grip. The contour of the cross section of the main grip portion comprises a u-shaped contour having a first end and a second end, and an arcuate contour having a first end and a second end. The first end of the arcuate contour intersects the first end of the u-shaped contour, and the second end of the arcuate contour intersects the second end of the u-shaped contour. The main grip portion thus comprises a lower u-shaped surface and an upper arcuate surface disposed along its length. The tapered grip portion further comprises a lower surface having a u-shaped cross section and an upper surface having an arcuate cross section. Each of the u-shaped surface and the arcuate surface on the tapered grip portion are tapered towards the hole disposed at the distal end of the grip, wherein the center of the bore is disposed along a line segment drawn from the lowermost point on the u-shaped contour to the uppermost point on the arcuate contour at a point which is between about 50% and 480% of the total distance from the lowermost point on the u-shaped contour to the uppermost point on the arcuate contour, and is most preferably about 65% of the total distance from the lowermost point on the u-shaped contour to the uppermost point on the arcuate contour.

The invention also provides a process for a person to putt a golf ball comprising the steps of: a) providing a golf putter comprising the above-described grip; b) grasping the grip in such fashion that each of the thumbs of the person are arranged in adjacently to one another in such fashion that the thumbprints of the person are contacting the upper main grip surface and wherein the grip is disposed between the persons palms; c) swinging the putter; and d) striking the golf ball.

DETAILED DESCRIPTION

Figure 1:
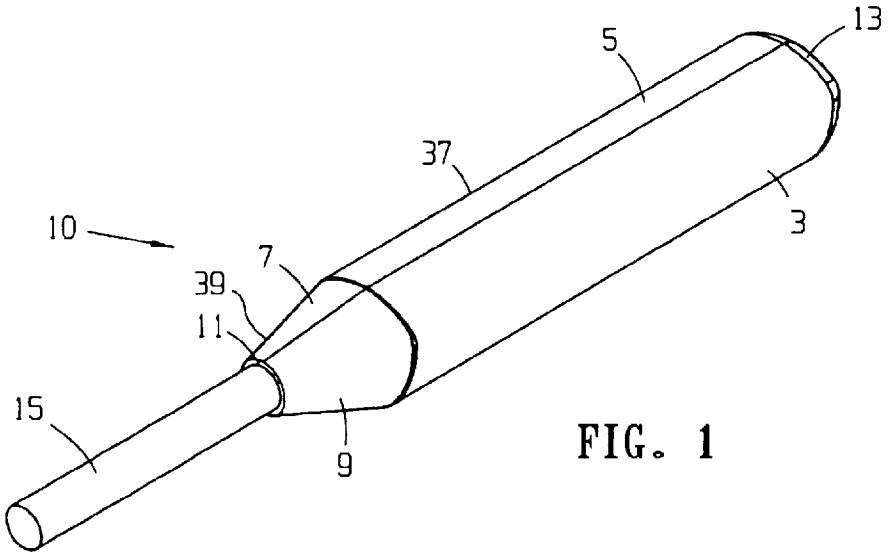
FIG. 1 shows a distal end perspective view of a putter grip according to a preferred form of the invention.

Referring to the drawings and initially to FIG. 1 there is shown a distal end perspective view of a putter grip 10 according to a preferred form of the invention. A grip according to the invention has a main grip portion 37 which includes a first end portion and a second end portion, and comprises a lower main grip surface 3 and an upper main grip surface 5. There is a tapered grip portion 39 which includes a first end portion and a second end portion and comprises an upper grip taper surface 7 and a lower grip taper surface 9. The grip includes a proximal end 13 disposed at the first end portion of the main grip portion and a distal end 11 which is disposed at the first end portion of the tapered grip portion. The second end portion of the main grip portion is attached to the second end portion of the tapered grip portion. Also shown in this figure is the club shaft 15 which is disposed in a bore located within the grip as a whole, as is more clearly shown in FIG. 3.

Figure 2:
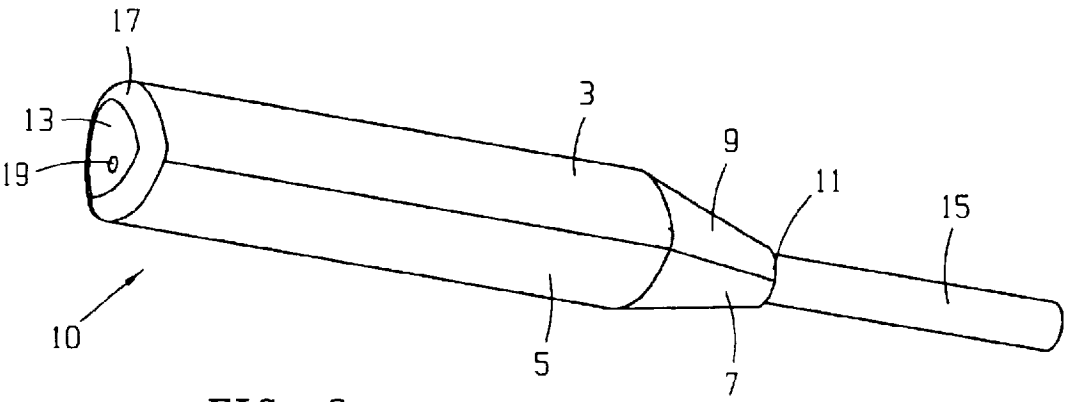
FIG. 2 shows a proximal end perspective view of a putter grip according to a preferred form of the invention.

FIG. 2 shows a proximal end perspective view of a putter grip 10 according to a preferred form of the invention showing the respective locations of the lower main grip surface 3, the upper main grip surface 5, upper grip taper surface 7, lower grip taper surface 9 and club shaft 15. The proximal end 13 of the grip and distal end 11 of the grip is also shown, as well as the bevel 17, which is merely a curved surface which circumscribes the end portion of the main grip portion as it tapers down to the proximal end 13 of the grip. There is a hole 19 disposed through the end of the proximal end portion 13, to enable air within the bore (FIG. 3) to escape when the grip 10 is installed on the end of a putter shaft 15.

Figure 3:
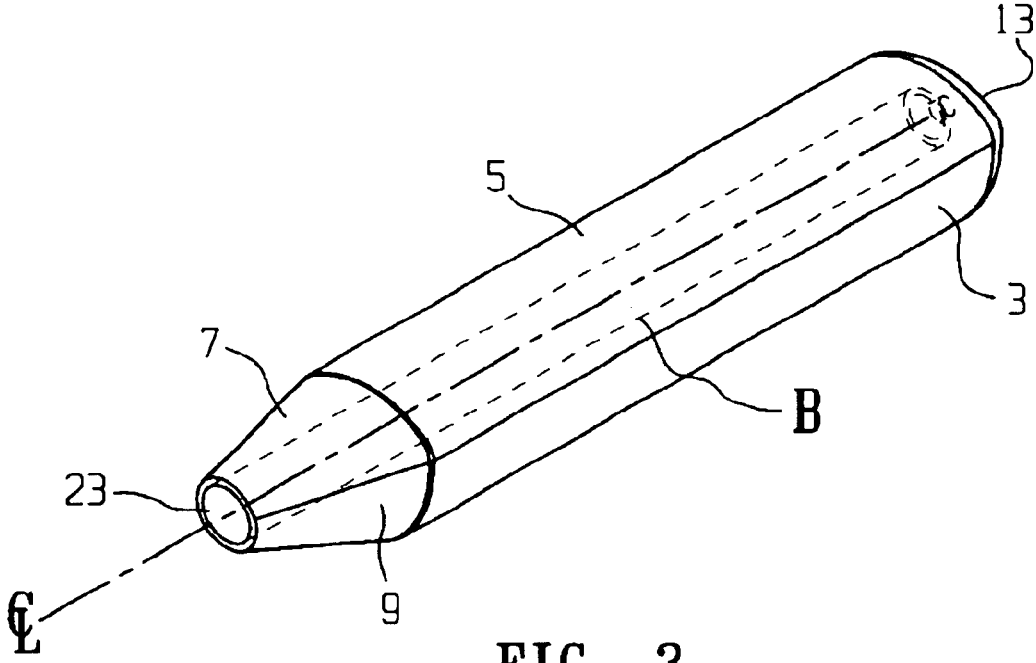
FIG. 3 shows a distal end perspective view of a putter grip according to a preferred form of the invention.

FIG. 3 shows a distal end perspective view of a putter grip 10 according to a preferred form of the invention, showing the respective locations of the upper grip taper surface 7, lower grip taper surface 9, upper main grip surface 5, lower main grip surface 3, and proximal end 13. There is a bore B disposed through the grip itself, which has a hole 23 at its end that is open to the external surroundings, which bore end coincides with the distal end 11 of the grip (FIG. 1). The bore B may extend into the grip to any desired depth, but preferably extends to a depth of between about 50% to 100% of the entire length of the grip 10, with a depth of about 99% of the entire length of the grip being most preferred. To install a grip according to the invention to an existing putter shaft, one merely inserts the putter shaft into the bore opening (hole) at the distal end 11 of the grip and applies inward force until the end of the club shaft rests in the bore at a desired location, which is preferably as far as the depth of the bore permits. A lubricant such as soapy water, or a grip solvent specifically formulated for this purpose is instrumental in facilitation of the insertion.

Figure 4:
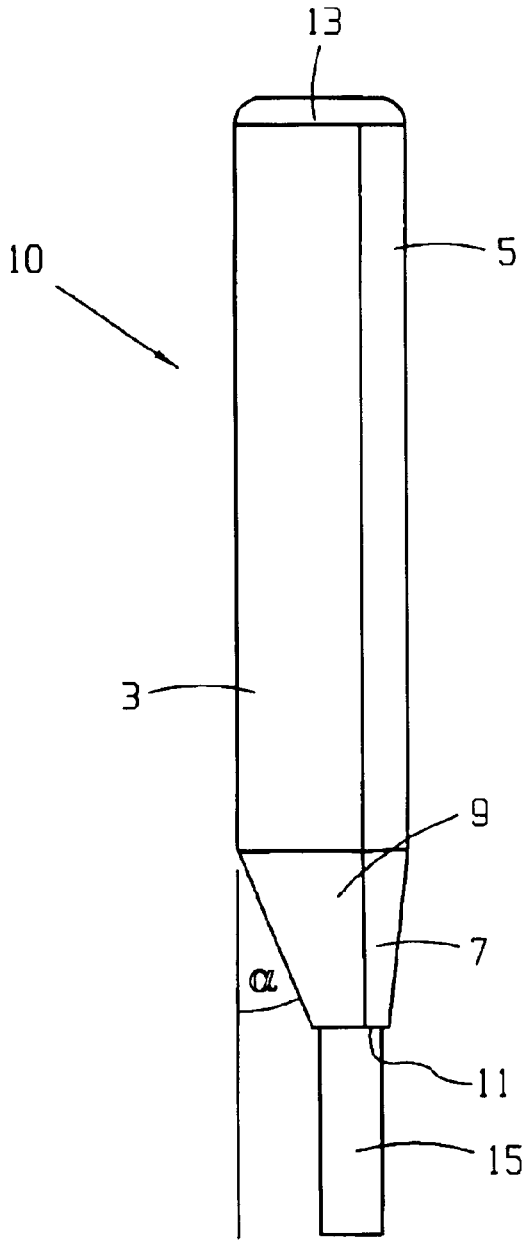
FIG. 4 shows a right side elevation view of a putter grip according to a preferred form of the invention.

FIG. 4 shows a right side elevation view of a putter grip 10 according to a preferred form of the invention, showing the respective locations of the lower main grip surface 3, upper main grip surface 5, upper grip taper surface 7, lower grip taper surface 9, proximal end 13 of the grip 10, distal end 11 of the grip 10, and club shaft 15. A left side elevation view of the putter grip 10 according to a preferred form of the invention is not shown, it being understood that the left side elevation view of the grip 10 is a mirror image of the right side elevation view, as the grip is symmetrical in this regard. Also shown in FIG. 4 is the angle alpha, which is the angle at which the lower grip taper surface 9 intersects with the lower main grip surface 3 as viewed from the side elevation. This angle may be any angle between about 10 degrees and 45 degrees, including every degree therebetween, and is preferably between about 15 degrees and 30 degrees, with an angle of about 22–24 degrees being most preferred.

Figure 5:
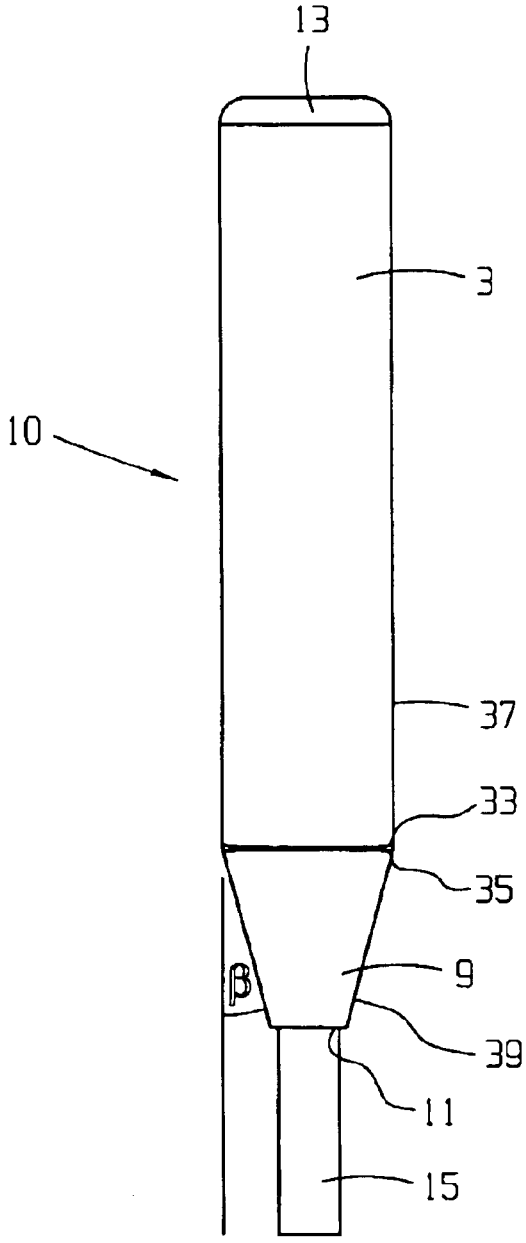
FIG. 5 shows a bottom view of a putter grip according to a preferred form of the invention.

FIG. 5 shows a bottom view of a putter grip 10 according to a preferred form of the invention showing the respective locations of the lower main grip surface 3, lower grip taper surface 9, proximal end 13, and club shaft 15. Also shown in FIG. 5 is the angle beta, which is the angle at which the lower grip taper surface 9 intersects with the lower main grip surface 3 as viewed from the bottom perspective. This angle may be any angle between about 10 degrees and 45 degrees, including every degree therebetween, and is preferably between about 15 degrees and 30 degrees, with an angle of about 20 degrees being most preferred. FIG. 5 also shows the second end portion 33 of the main grip portion 37, as well as the second end portion 35 of the tapered grip portion 39.

Figure 6:
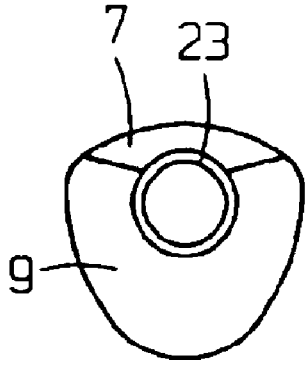
FIG. 6 shows a distal end view of a putter grip according to a preferred form of the invention.

FIG. 6 shows a distal end view of a putter grip 10 according to a preferred form of the invention, showing the respective locations of the lower grip surface taper 9, upper grip surface taper 7, and hole 23.

Figure 7:
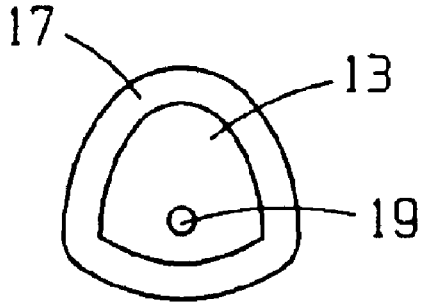
FIG. 7 shows a proximal end view of a putter grip according to a preferred form of the invention.

FIG. 7 shows a proximal end view of a putter grip 10 according to a preferred form of the invention, showing the respective locations of the proximal end 13, bevel 17, and air hole 19.

Figure 8:
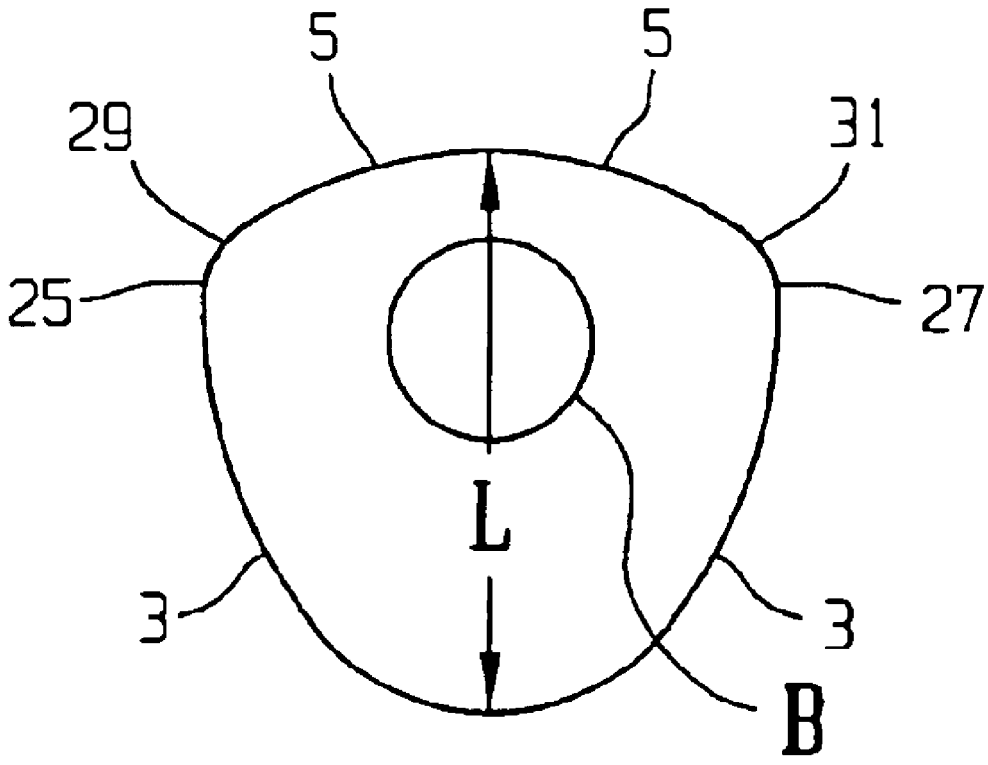
FIG. 8 shows a distal end view of a putter grip according to a preferred form of the invention.

FIG. 8 shows a cross sectional view of a putter grip 10 according to a preferred form of the invention. In this figure is shown the respective locations of the lower main grip surface 3 and the upper main grip surface 5. Thus, it can be seen that the cross sectional contour of the lower main grip surface 3 is generally u-shaped, and has a first end portion 25 and a second end portion 27, as viewed in the cross section. It is further seen that the cross sectional contour of the upper main grip surface 5 is an arcuate contour which has a first end portion 29 and a second end portion 31. The first end portion 29 of the upper main grip surface's arcuate contour 5 intersects with the first end portion of the lower main grip surface's u-shaped contour 25, and the second end portion 31 of the upper main grip surface's arcuate contour 5 intersects with the second end portion 27 of the lower main grip surface's u-shaped contour 27, as viewed in the cross section. In one preferred form of the invention, the lower main grip's u-shaped contour is substantially parabolic. This FIG. 8 also shows the location of the bore B with respect to a line segment L drawn from the lowermost point on the u-shaped contour to the uppermost point on the arcuate contour. The center of the bore B is located at a point along this line segment L which is between about 50% and 80% of the total distance from the lowermost point on the u-shaped contour to the uppermost point on the arcuate contour. In one preferred form of the invention, the center of the bore B is located at a point along this line segment L which is about 60% of the total distance from the lowermost point on the u-shaped contour to the uppermost point on the arcuate contour. The diameter of the bore B is any diameter in the range of between about 9 mm and 18 mm, with a diameter of about 14–15 mm being most preferred.

Figure 9:
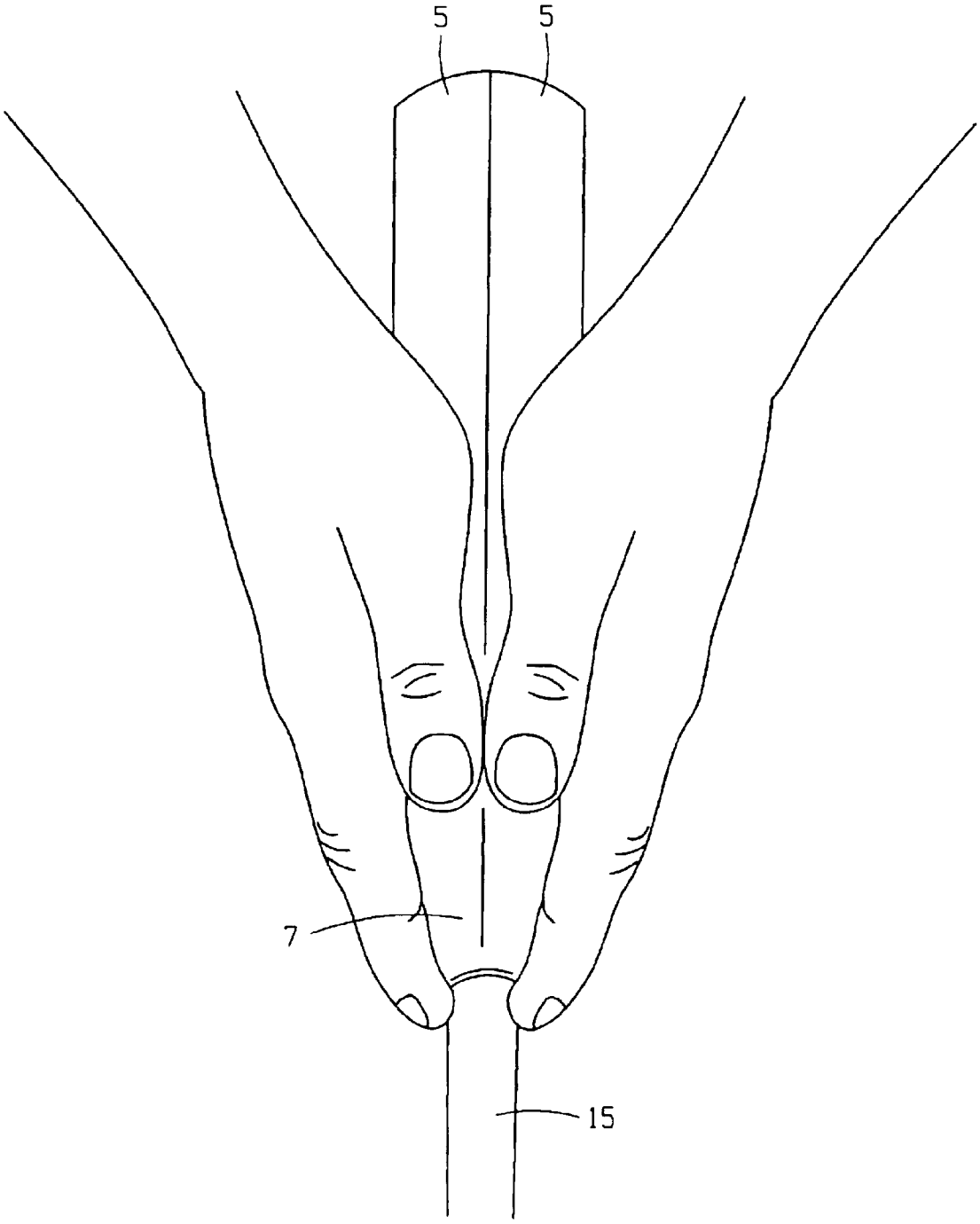
FIG. 9 shows a front view of a person's hands gripping a putter grip according to a preferred form of the invention.

FIG. 9 shows a front view of a person's hands gripping a putter grip 10 according to a preferred form of the invention, and showing the respective positions of the upper main grip surface 5, upper grip surface taper, and club shaft 15.

Figure 10:
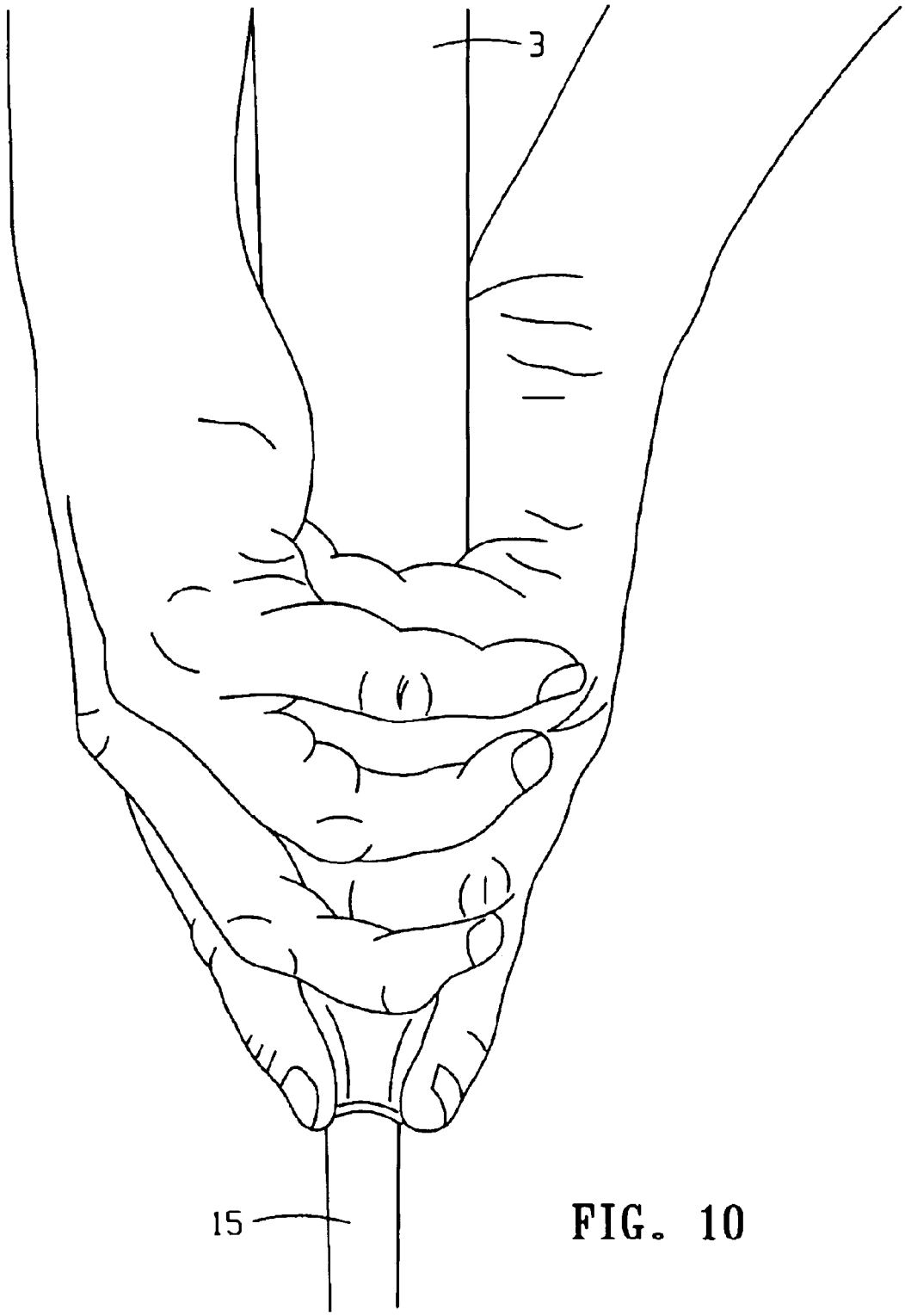
FIG. 10 shows a rear view of a person's hands gripping a putter grip according to a preferred form of the invention.

FIG. 10 shows a rear view of a person's hands gripping a putter grip 10 according to a preferred form of the invention, and showing the respective locations of the lower main grip surface 3 and the club shaft 15.

Figure 11:
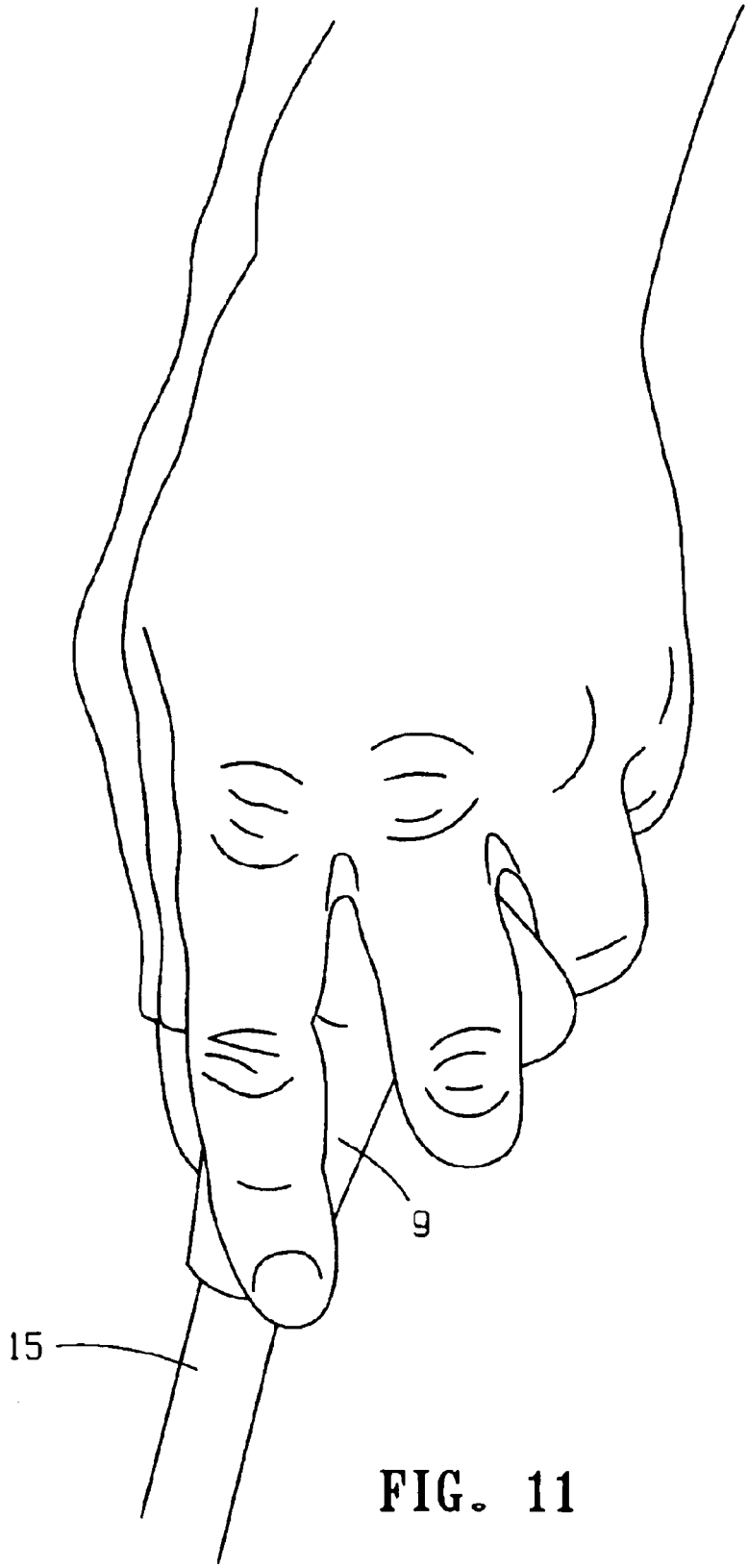
FIG. 11 shows a left side view of a person's hands gripping a putter grip according to a preferred form of the invention.

FIG. 11 shows a left side view of a person's hands gripping a putter grip 10 according to a preferred form of the invention, showing the respective locations of the lower grip taper surface 9 and club shaft 15.

The unique nature of the grip is its size and shape, which allow the hands to grasp the club opposite each other during its use, rather than being separated vertically as in prior art grips and methods associated with their use. According to the invention, the palms rest on each side of the grip; the thumbs are side-by-side extending downward on the bevels on each side of the front of the grip and the forefingers and middle fingers extend downward to the base of the grip. For maximum stability, the forefingers point straight down and are pressed against opposite sides of the grip at or near the base, and the small fingers overlap at the back of the grip. The club drops naturally through the fingers to address the ball, with the palms pressed gently on the sides of the grip and the fingers relaxed.

A putting method according to the invention and using a grip according to the invention encourages consistent placement of the hands on the club and allows the hands to work in concert with minimum wrist movement. It also allows the shoulders to be square to the ground, promoting a consistent pendulum motion with the club. By allowing the fingers to extend naturally toward the ground in addressing the ball, extending the arms with only a slight elbow bend, and pressing the palms gently together, the user consistently experiences a smooth, straight, stable putting motion, time after time.

The putter head can be easily controlled with this grip, allowing the user to hover the club above the green before striking the ball. This allows the putter to strike the ball in the upper half, ensuring a proper roll of the ball toward the hole. The enhanced control of the club head also allows the user to strike the ball on the sweet spot of the putter every time, ensuring a putt along the chosen path.

The United States Golf Association ("USGA") promulgates regulations concerning sizes and shapes of golf clubs and grips which are deemed permissible for play. A grip according to the invention may be easily provided in the form of a single construct, preferably by injection molding or other molding, to conform to USGA standards. Accordingly, a grip according to the invention is preferably made from an elastomeric material, such as from thermoset resins and thermoplastic resins, as the use of such materials are known in the art of golf club grip construction. These include without limitation various rubbers, polyolefins, and various composites such as fiberglass and graphite composites.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. The present invention further includes all possible combinations of the features recited in the specification and/or any one of the various claims appended hereto with the features recited elsewhere in the specification and/or in any one or more of each of the remaining claims. Accordingly, the presently disclosed invention is intended to cover all such modifications, alterations, and combinations.

I claim:

1. A putter grip having a distal end, a proximal end, and a length dimension, comprising:

a) a main grip portion having a first end portion and a second end portion, wherein said first end portion of said main grip portion coincides substantially with said proximal end of said grip;

b) a tapered grip portion having a first end portion and a second end portion, wherein said first end portion of said tapered grip portion coincides substantially with said distal end of said grip, said second end portion of said main grip portion being attached to said second end portion of said tapered grip portion;

c) a bore disposed through said grip, having an open end which comprises a hole at said distal end of said grip;

wherein the contour of the cross section of the main grip portion comprises:

i) a u-shaped contour having a first end and a second end, and ii) an arcuate contour having a first end and a second end, wherein said first end of said arcuate contour intersects said first end of said u-shaped contour, and wherein said second end of said arcuate contour intersects said second end of said u-shaped contour, said main grip portion thus comprising a lower u-shaped surface and an upper arcuate surface disposed along its length, said tapered grip portion further comprising a lower surface having a u-shaped cross section and an upper surface having an arcuate cross section, each of said u-shaped surface and said arcuate surface on said tapered grip portion being tapered towards said hole disposed at said distal end of said grip, wherein the center of said bore is disposed along a line segment drawn from the lowermost point on the u-shaped contour to the uppermost point on the arcuate contour at a point which is between about 50% and 80% of the total distance from the lowermost point on the u-shaped contour to the uppermost point on the arcuate contour.

2. A grip according to claim 1 wherein the center of said bore is disposed along a line segment drawn from the lowermost point on the u-shaped contour to the uppermost point on the arcuate contour at a point which is about 65% of the total distance from the lowermost point on the u-shaped contour to the uppermost point on the arcuate contour.

3. A grip according to claim 1 wherein said length of said grip is any length between about 15 centimeters and about 30 centimeters.

4. A grip according to claim 1 wherein said length of said grip is about 22 centimeters.

5. A grip according to claim 1 wherein the length dimension of said tapered grip portion is between 25 and 100 mm.

6. A grip according to claim 1 wherein the largest cross sectional dimension of said grip is not greater than 44.45 millimeters.

7. A grip according to claim 1 wherein the longest cross sectional diameter of said main grip portion is between 38 and 45 mm.

8. A grip according to claim 1 wherein the longest cross sectional diameter of said tapered grip portion is between 38 and 45 mm.

9. A grip according to claim 1 wherein said bore has a diameter of any diameter in the range of between about 9 mm and 18, and wherein said bore extends into the grip to a depth of between about 50% to 100% of the entire length of the grip, and wherein said grip is adapted to receive the shaft of a golf putter.

10. A grip according to claim 1 wherein said main grip portion is substantially uniform in cross sectional contour along its entire length.

11. A grip according to claim 1 and further comprising a shaft disposed in said bore.

12. A grip according to claim 1 wherein said grip meets USGA standards.

13. A grip according to claim 1 wherein said unshaped surface is substantially parabolic.

14. A grip according to claim 1 wherein the upper and lower surfaces on the main grip portion are uniform.

15. A grip according to claim 1 which comprises an elastomeric material.

16. A grip according to claim 15 wherein said elastomeric material is a thermoset elastomer.

17. A grip according to claim 15 wherein said elastomeric material is a thermoplastic elastomer.

18. A grip according to claim 1 further comprising a golf club shaft disposed in said bore, wherein said club shaft has a first end portion and a second end portion, wherein said first end portion is disposed in said bore and wherein said second end portion of said club shaft includes a putter head.

19. A golf putter comprising the grip of claim 1.

20. A process for a person to putt a golf ball comprising the steps of:

a) providing a golf putter according to claim 19;

b) grasping said grip in such fashion that each of the thumbs of said person are arranged in adjacently to one another in such fashion that the thumbprints of said person are contacting said upper main grip surface and wherein said grip is disposed between the persons palms;

c) swinging said putter; and d) striking said golf ball.

* * * * *